United States Patent [19]

La Bate

[11] Patent Number: 4,538,795

[45] Date of Patent: Sep. 3, 1985

[54] DEVICE FOR INTRODUCING GAS INTO MOLTEN METAL IN CONTROLLED STREAMS

[76] Inventor: Michael D. La Bate, 115 Hazen Ave., Ellwood City, Pa. 16117

[21] Appl. No.: 662,831

[22] Filed: Oct. 19, 1984

[51] Int. Cl.[3] ..... C21C 5/48

[52] U.S. Cl. ..... 266/220; 266/266

[58] Field of Search ..... 266/217, 220, 224, 266

[56] References Cited

U.S. PATENT DOCUMENTS

| | | | |
|---|---|---|---|
| 2,811,346 | 10/1957 | Spire | 266/220 |
| 3,208,117 | 9/1965 | Goedecke et al. | 75/59 |
| 3,330,645 | 7/1967 | Moustier et al. | 266/220 |
| 3,610,602 | 10/1971 | Deacon et al. | 266/220 |
| 3,834,685 | 9/1974 | Ziemkiewicz et al. | 266/220 |
| 4,053,147 | 10/1977 | Moser et al. | 266/220 |
| 4,396,179 | 8/1983 | La Bate | 266/220 |

FOREIGN PATENT DOCUMENTS

| | | | |
|---|---|---|---|
| 849446 | 8/1970 | Canada | 266/220 |
| 2451945 | 10/1980 | France . | |

*Primary Examiner*—L. Dewayne Rutledge
*Assistant Examiner*—Robert L. McDowell
*Attorney, Agent, or Firm*—Harpman & Harpman

[57] ABSTRACT

A solid non-permeable refractory plug has a spaced stainless steel jacket and is located in a pocket block for incorporation in the normal refractory brick lining of a ladle to provide a structure through which gas can be introduced into the molten metal. An upstanding arcuate deflector on the stainless steel jacket covers a substantial portion of the open upper end of the jacket to deflect gas flowing upwardly through the device into two separate and distinct streams resulting in an improved stirring action in the molten metal while serving to displace the molten metal that would otherwise tend to flow into the device and close the gas passageway.

3 Claims, 3 Drawing Figures

DEVICE FOR INTRODUCING GAS INTO MOLTEN METAL IN CONTROLLED STREAMS

BACKGROUND OF THE INVENTION

1. Technical Field

This invention relates to devices for insufflating gas into a mass of molten metal.

2. Description of the Prior Art

Prior structures of this type have generally employed permeable plugs through which the gas in introduced into the molten metal. Such typical devices may be seen in U.S. Pat. Nos. 2,811,346, 3,330,645, 3,610,602, 3,834,685 and 4,053,147. In all of these prior art devices, the gas must flow upwardly through a gas permeable body which in U.S. Pat. No. 3,811,346 is a porous refractory material. The same porous material is disclosed in U.S. Pat. No. 3,330,645 and this patent additionally proposes to form tubular passageways through the porous material. The body of the device in U.S. Pat. No. 3,610,602 is formed of permeable refractory as is the body of the device shown in U.S. Pat. No. 3,834,685 and the same is true of the body of the device shown in U.S. Pat. No. 4,053,147.

French Pat. No. 2,451,945 has a porous stoppler plug, as has U.S. Pat. No. 3,208,117.

The present invention comprises an improvement with respect to my U.S. Pat. No. 4,396,179 wherein a non-permeable refractory plug is disclosed having a spaced stainless steel jacket thereabout forming an annular passageway through which the gas is introduced into the molten metal. A displaceable cap is provided in this device for initially protecting the upper end of the device and the annular gas passageway from being plugged by molten metal introduced into the ladle in which the device is positioned. In actual practice, it has been determined that the cap is frequently displaced by the molten metal and the molten metal tends to plug the annular gas passageway unless a substantially higher gas pressure is employed to move the molten metal away from the annular gas emitting opening.

Furthermore, the molten metal first introduced into a ladle equipped with the device tends to freeze almost instantaneously and frequently before the gas is introduced or during the initial introduction of the gas and thus closes the annular gas passageway and renders the device ineffective.

The present invention adds a deflector arching above the annular gas emitting passageway of the device and protects the passageway and the upper portion of the device from the molten metal whether the gas is flowing or not and when the gas flows, it improves the stirring action substantially by forming two separate and distinct and horizontally spaced streams of the gas bubbles which result in increased turburlence and stirring action in the molten metal.

SUMMARY OF THE INVENTION

A device for introducing gas into molten metal upon the filling of a ladle or the like with such molten metal uses a pocket block of refractory which is incorporated in the brick or rammed lining of the ladle, the block having a vertically extending passageway therethrough and a plug positioned therein comprising a non-permeable refractory plug with a spaced stainless steel or ceramic shell thereabout to define a gas passageway through the block. A combined shield and deflector in the form of an upwardly arching arcuate shape is attached at its ends to the shell so as to be positioned over the opening defined thereby and the upper portion of the non-permeable refractory plug whereby gas for agitating, stirring rolling and/or affecting the desired chemistry of the molten metal can be introduced into the molten metal in horizontally spaced columns substantially increasing the agitating stirring and rolling action obtained.

DESCRIPTION OF THE PREFERRED EMBODIMENT

Figure 1:
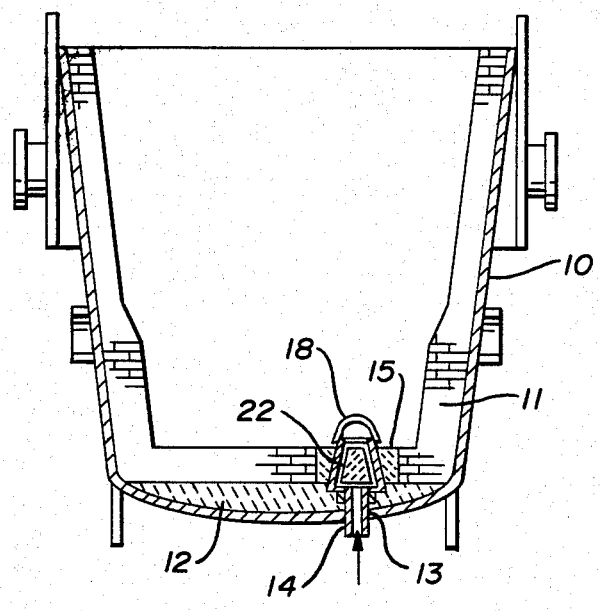
FIG. 1 is a sectional side elevation of a ladle showing the device for introducing gas into molten metal installed therein.
Figure 2:
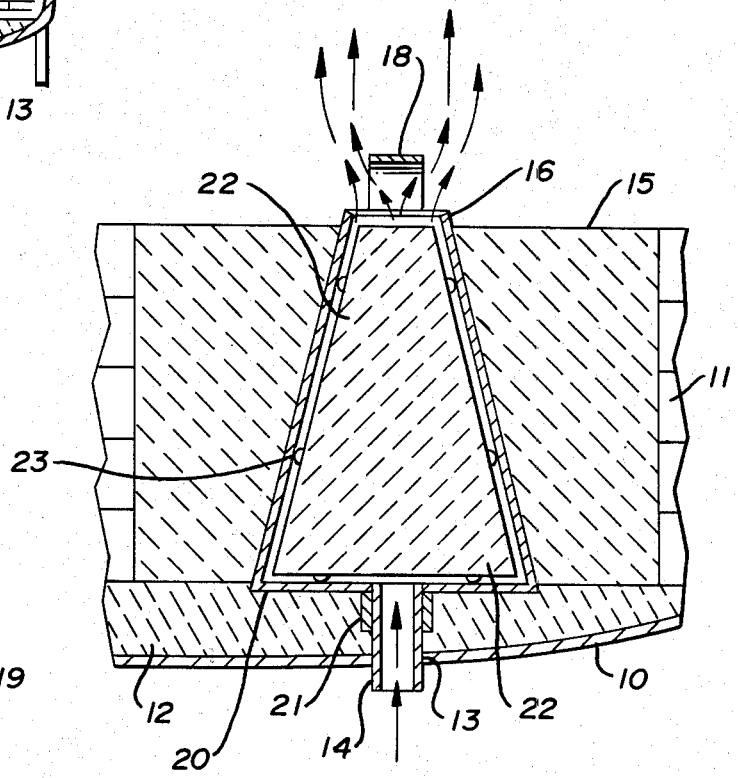
FIG. 2 is an enlarged cross sectional detail of the device for introducing gas into molten metal and illustrating the deflector with arrows indicating the dual streams of gas occasioned by its presence.
Figure 3:
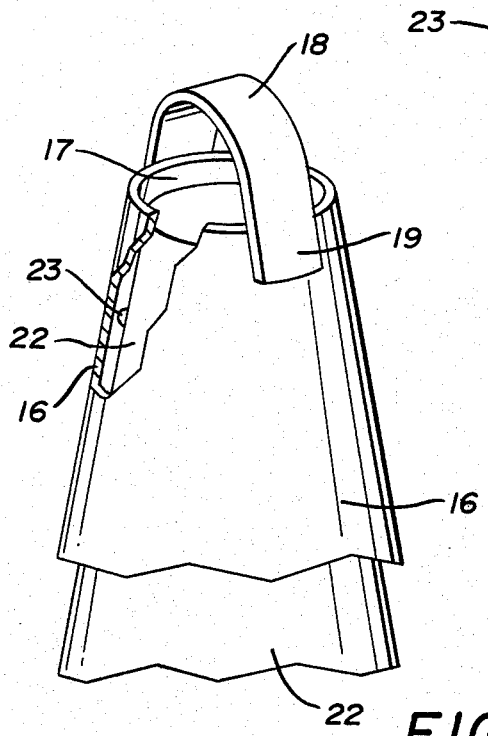
FIG. 3 is an enlarged perspective elevation with parts broken away and parts in cross section of the upper portion of the device of the invention.

In the form of the invention chosen for illustration herein, the device for introducing gas into molten metal in an improved manner may be seen in FIGS. 1, 2 and 3 of the drawings in a ladle 10 having a refractory brick lining 11 incorporating a rammed refractory base 12. An opening 13 in the bottom of the ladle 10 is provided with a tube 14 through which gas is introduced. A pocket block 15 is provided with a conical passageway centrally thereof which is arranged in registry with the upper end of the tube 14. A frusto-conical shell 16, preferably made of stainless steel or a fired ceramic or a ceramic coated metal as best seen in FIGS. 2 and 3 of the drawings, has an open upper end 17 protected by a deflector 18 in the form of an inverted U-shaped band of stainless steel, ceramic or ceramic coated metal, the ends 19 of the band 18 being attached to the frusto-conical shell 16 inwardly of the upper end thereof. The deflector 18 is of a width to substantially cover the opening 17 formed by the open upper end of the frusto-conical shell 16.

By referring to FIG. 2 of the drawings, it will be seen that the bottom of the frusto-conical shell 16 comprises a circular disc 20 having an annular depending flange 21 centrally thereof about an opening therethrough, the flange 21 being adapted for registry over the tube 14 through which the gas is introduced into the ladle as illustrated by the arrows.

The majority of the interior of the frusto-conical shell 16 is filled by a non-permeable ceramic plug 22 and configurations 23 on the exterior of the plug 22 or alternately on the interior of the shell 16 provide for the spacing of the shell 16 with respect to the plug 22 so that a gas passageway annular in cross section is formed through the pocket block 15 and thus provides that gas introduced into the tube 14 will flow around the exterior of the plug 22 and outwardly through the opening 17 and be effectively deflected by the deflector 18 as shown by the arrows in FIG. 2 of the drawings.

By referring to FIG. 2 of the drawings in particular, it will be observed that the arrows indicating the gas flow paths as occasioned by the deflector 18 are separate and distinct horizontally spaced columns which have the highly desired effect of substantially increasing the agitating, stirring and rolling action of the molten metal through which the gas streams move.

In FIG. 1 of the drawings, the device is shown in operable arrangement in the ladle 10 and it will be observed that it is of a size and so located in the ladle that the dual streams of gas emerging from the device by reason of the deflector 18 will occupy a substantially larger overall area in the ladle 10 than has heretofore been possible with the prior art devices.

In operation, the device is installed in the conical passageway in the pocket block 15 immediately prior to the installation of the pocket block 15 in the lining of the ladle 10. Such installation is facilitated by the presence of the deflector 18 as the same forms a convenient handle in holding and adjusting the device in the conical passageway of the pocket block 15 and insuring the positioning of the device and more particularly the frusto-conical shell 16 thereof in engaging relation in the conical passageway as the pocket block 15 is positioned in the lining of the ladle for registry with the opening of the refractory base 12 through which the tube 14 extends.

In FIG. 2 of the drawings, the ends of the deflector 18 are illustrated as extending downwardly along the outer sides of the frusto-conical shell 16 to their points of attachment and it will be observed that the upper portions of the shell 16 and the adjacent portions 19 of the deflector 18 are covered by the wall of the pocket block 15 and thus protected from rapid erosion.

The arrangement is such that the deflector 18 is protected by the cooling effect of the gas being introduced through the device and directed thereagainst by the formation of the opening 17 with the result that metal initially poured into the ladle 10 and striking the deflector 18 does not adversely affect the deflector 18 which remains in position through the initial pouring stages and thereafter when the molten metal has covered the same, all due to the effective cooling, stirring, agitating and rolling action of the molten metal as occasioned by the dual streams of the gas being introduced thereinto.

It will occur to those skilled in the art that the device disclosed herein protects the frustro-conical shell thereof as well as preventing the plugging of the annular gas passageway defined between the shell 16 and the plug 22 as would otherwise occur upon the introduction of molten metal into the ladle. The solid ceramic plug 22 cannot be filled with metal as occurs in the prior art devices wherein the plugs are formed of porous refractory material and the device thereby insures the desirable immediate introduction of gas into the molten metal which has heretofore been seriously delayed by the blocking of the prior art devices with the molten metal and the unprotected defusing plugs and the like.

The vertical dimension of the pocket block 15 adjacent the conical passageway is substantially the same as the height of the solid ceramic plug 22, and the height of the shell 16 without the deflector 18 is greater than the height of the pocket block 15 so as to form a hot metal dam around the annular gas passageway.

Although but two embodiments of the present invention have been illustrated and described, it will be apparent to those skilled in the art that various changes and modifications may be made therein without departing from the spirit of the invention and having thus described my invention.

What I claim is:

1. In a device for introducing gas into a mass of molten metal, the improvement which comprises a solid body of refractory material and a shell positioned thereabout in spaced relation thereto and defining an opening around and above said solid body, a deflector positioned above said solid body and attached to said shell, a pocket block having a passageway extending vertically therethrough, said pocket block adapted to form a portion of a refractory lining in a container for said molten metal, said container having an opening therein in registry with said passageway in said pocket block, said solid body and said shell positioned in said passageway in said pocket block with said deflector extending outwardly of and above said passageway in said pocket block in at least partially covering relation to said solid body and shell and facing the interior of said container so as to form more than one stream of gas rising in said molten metal when said gas is introduced through said device.

2. The improvement in a device for introducing gas into a mass of molten metal set forth in claim 1 and wherein said deflector comprises a strip of material of inverted U-shape, the ends of the strip of material being attached to said shell.

3. The improvement in a device for introducing gas into a mass of molten metal set forth in claim 1 and wherein the overall height of said solid body is less than the height of said vertical passageway in said pocket block and wherein said deflector extends upwardly and outwardly of said passageway in said pocket block.

* * * * *